United States Patent [19]

McCormick

[11] Patent Number: 4,730,848

[45] Date of Patent: Mar. 15, 1988

[54] CREDIT CARD TRANSACTION SLIPS PACK AND METHOD OF MAKING

[75] Inventor: Joseph A. McCormick, Manhattan, Ill.

[73] Assignee: General Credit Card Forms, Inc., Earth City, Mo.

[21] Appl. No.: 869,008

[22] Filed: May 19, 1986

[51] Int. Cl.[4] ..... B41L 1/20

[52] U.S. Cl. ..... 282/8 R; 282/9 R

[58] Field of Search ..... 282/8 R, 9 R, 11 R, 282/11.5 A

[56] References Cited

U.S. PATENT DOCUMENTS 4,614,362 9/1986 Breen et al. ..... 282/9 R 4,614,363 9/1986 Breen ..... 282/9 R X

*Primary Examiner*—Paul A. Bell

*Attorney, Agent, or Firm*—Marshall, O'Toole, Gerstein, Murray & Bicknell

[57] ABSTRACT

An improved pack of credit card transaction slips and method of making same. A pigment coating is applied to the eventual lower face (back) of translucent paper forming the top transaction slip. The color of the pigment coating contrasts with the duplicating medium. When the duplicating medium is imprinted on the lower face during a credit card transaction, the visibility and legibility of the duplicating medium imprint viewed from the upper face (front) and through the top transaction slip is significantly improved.

14 Claims, 3 Drawing Figures

CREDIT CARD TRANSACTION SLIPS PACK AND METHOD OF MAKING

This invention relates to credit card transaction slips, and in particular to an improved pack of transaction slips and method of making same to significantly improve the visibility of information imprinted on the lower face or back of the top transaction slip and at a lower manufacturing cost.

BACKGROUND OF THE INVENTION

Reference may be made to the following U.S. Patents of interest: U.S. Pat. Nos. 1,845,568; 3,113,516; 3,203,832; 3,290,060; 3,410,711; 4,045,053; 4,403,793.

Credit card transaction slips are in common use for commercial transactions. Normally, two or more transaction slips are bound together at one end with a duplicating medium slip or duplicating carbon slip to form a pack or form set. The transaction slips have particular locations and blocks of locations printed on the slip for recording information related to the commercial transaction.

Typically, the customer's credit card with information in raised sections is placed in an imprinting fixture. The transaction slip pack is placed on top of the credit card and a roller is rolled over the pack and credt card. Information on the raised section of the credit card is thus transferred by imprinting the duplicating medium onto the lower face, i.e., the back or reverse side, of the top transaction slip as well as onto the upper face, i.e., the front side, of the bottom transaction slip. The imprinted information may consist of the credit card customer's name, expiration date, and account number, the name, address and account number of the merchant (found on the merchant plate/card attached on the imprinter fixture), and the transaction dollar amount.

Thus, during imprinting, the raised numbers and letters on the customer's credit card and the merchant's plate are transferred for the duplicating medium slip, such as a carbon paper, to the lower face (back) of the top transaction slip and to the upper face (front) of the bottom transaction slip. Since the imprinted carbon numbers and letters on the lower face of the top transaction slip must be read through the top slip from the upper face, it is required that the imprinting be legible when viewed through the paper.

Paper mills manufacture the paper to be used for the top transaction slips on a paper machine using special pulps and other special machinery and processes to make the paper more nearly transparent and at least as transparent as possible. Other paper mills who do not use special pulps or have such special machinery treat translucent paper with chemical solutions or chemical coatings which impregnate the paper to make the paper as near transparent as possible. The terms "transparent", "translucent" and "opaque" as used herein are defined as follows: "transparent" means having the property of transmitting light without appreciable scattering or diffusion so that bodies lying beyond are entirely visible; "translucent" means having the property of admitting and diffusing light so that objects beyond cannot be clearly distinguished; and "opaque" means having the property of blocking light to the extent that objects beyond cannot be distinguished.

In both of the aforementioned prior art techniques, paper manufacturers or others attempt to make the paper as transparent as possible in order that the carbon imprint on the lower face of the paper can be a visible and legible as possible when viewed from the top face and through the paper. Thus, in the prior art, an initial translucent paper, i.e., a paper which admits and diffuses light so that objects beyond cannot be clearly distinguished, is treated to make the paper more nearly transparent so that objects beyond the paper can become more nearly visible and legible when viewed through the paper.

Despite such prior expensive efforts, sometimes the imprinting on the top transaction slip is not as visible and legible as desired. Also, the prior art attempts to make a more transparent top transaction slip require expensive, high quality paper and pulp or costly paper treating solutions and processes. Furthermore, even using such special pulps and special processes, there is sometimes produced a less nearly transparent paper, due to pulp quality, coating quality, etc. Prior art attempts to obtain legible imprinting are thus expensive, unreliable and do not consistently produce the previously desired more nearly transparent paper.

It is therefore desired to equal or improve the visibility and legibility of the lower face imprinting when viewed through the top transaction slip with the least expense as possible so that another grade, less expensive paper may be used with treating processes that are not as costly and which may be accomplished on a press and during the printing/manufacturing operation for a credit card from set or pack.

SUMMARY OF THE INVENTION

In accordance with the principles of the present invention, there is provided an improved pack of credit card transaction slips and a method of making thereof, wherein one face of translucent paper is coated with a pigment coating such as a white pigment coating. The translucent paper when viewed from and through the uncoated face is less transparent with the pigment coating than without the pigment coating. That is, in the visibility scale of from less visible to more visible corresponding to a range from near opaque to translucent to transparent, the untreated paper is translucent or partly transparent—whereas the same paper treated with the pigment coating on one face becomes less translucent or less transparent and more nearly opaque. The pigment coated paper is used as a top slip, sheet or ply in a pack of credit card transaction slips, with the pigment coated face being the lower face (back) of the sheet and the untreated face being the upper face (front) of the sheet.

A colored duplicating medium slip, i.e., a colored carbon slip is placed in the pack directly below the pigment coated lower face of the top transaction slip. The color of the carbon or duplicating medium is chosen to contrast with the color of the pigment coating, so that the pigment coating may be white and the carbon may be black. During imprinting of the credit card transaction, for instance, the black carbon is imprinted on the white pigment coating on the lower face of the top transaction slip. The color contrast between the pigment coating on the lower face of the top transaction slip and the black carbon imprint enables the black imprint to be significantly more visible when viewed from the upper face and through the transaction slip than when using the same translucent paper without the pigment coating.

In accordance with the method aspects of the present invention, a white pigment coating (or other color contrasting with a duplicating medium color) consisting of an opaque white ink is printed on one face (the face that comes in contact with the contrasting carbon slip) of the translucent paper during the credit card pack manufacturing process. Alternatively, the pigment coating can consist of a white ink mixed with alcohol which is known in the trade as "tinting", with the tinting applied to one face of the paper forming the transaction slip.

It has been found that the pigment coating on one face of the translucent paper can be applied to various grades of paper with a significant improvement in imprinting legibility. Thus, in accordance with this invention, specialty grade translucent papers as well as some commodity grade (less translucent or more nearly opaque) papers can be utilized with the pigment coating to realize the advantages of the present invention. This is a significant improvement over the prior art, since prior art techniques are substantially restricted to use with specialty grade translucent papers and cannot be used with some commodity grade papers which are less translucent or more nearly opaque. Since commodity grade (less translucent or more nearly opaque) papers are substantially less expensive than the specialty grade translucent papers, the present invention enables a significant savings in manufactured credit card form sets.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

DETAILED DESCRIPTION

Figure 1:
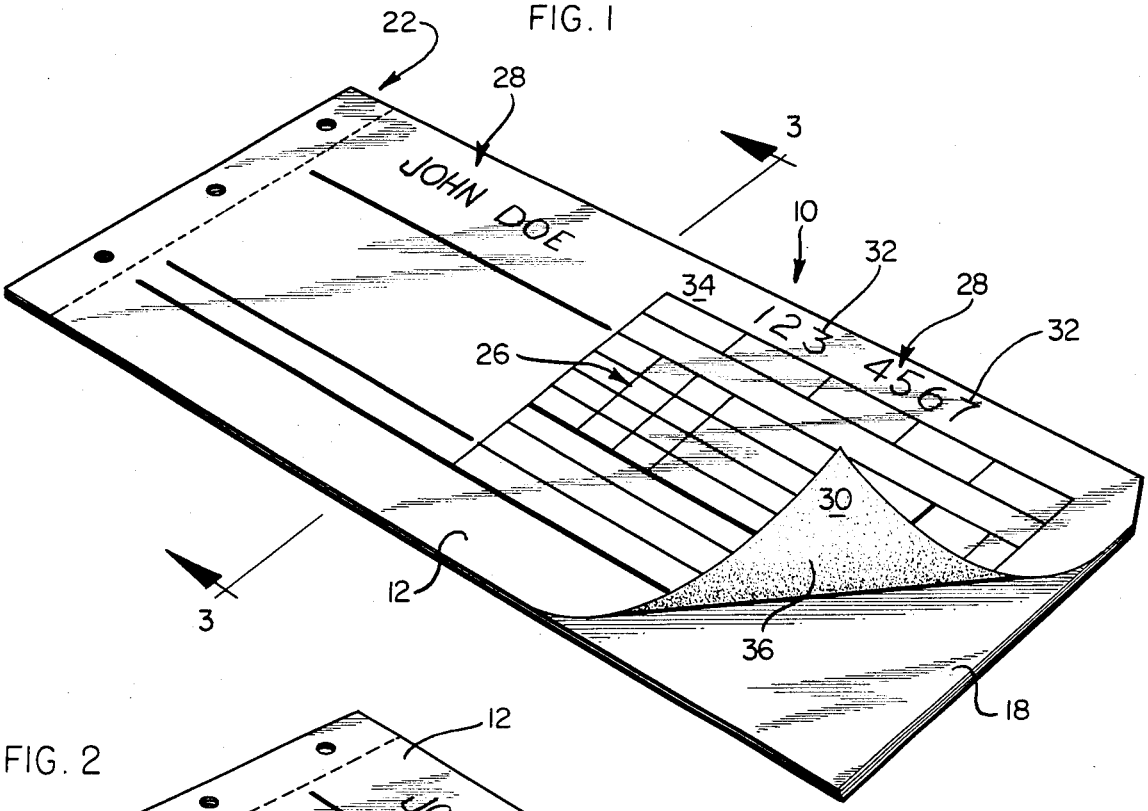
FIG. 1 is a perspective view of an improved pack of credit card transaction slips in accordance with the principles of the present invention.

For purposes of illustration, the drawings and the present description are directed to a preferred embodiment of the invention in which an assembled pack 10 or form set of credit card transaction slips includes three paper transaction slips 12, 14 and 16, with a respective slip being provided for a merchant, a customer and the credit card issuer or processor. It is to be understood that the preferred embodiment illustrated and to be described herein is provided merely to illustrate and describe the principles of the present invention. Thus the same principles illustrated and described herein may be applied to situations in which only two paper transaction slips and only one duplicating medium slip or one duplicating carbon slip is utilized, or to a four-part or five-part form set. Thus, no limitation in the appended claims is to be inferred from the present preferred embodiment illustration and description.

Middle transaction slip 14 is sandwiched between a pair of duplicating medium slips 18, 20 which are normally formed of duplicating carbon slips. Duplicating slip 18 (referred to in the trade as a double-face carbon) permits information imprinted on top transaction slip 12 to be entered and simultaneously placed onto middle transaction slip 14, and duplicating medium slip 20 (referred to in the trade as a single-face carbon) permits this same information to be simultaneously placed onto bottom transaction slip 16. Pack 10 is maintained together at one end 22 by means of a suitable adhesive 24 joining one end of each adjacent transaction slip and duplicating medium slip to each other at pack end 22. During the manufacturing process, the transaction slips are printed with the blocks, lines, and other indicia shown in FIG. 1, and are then joined together at one end with a duplicating medium using a suitable adhesive.

Figure 2:
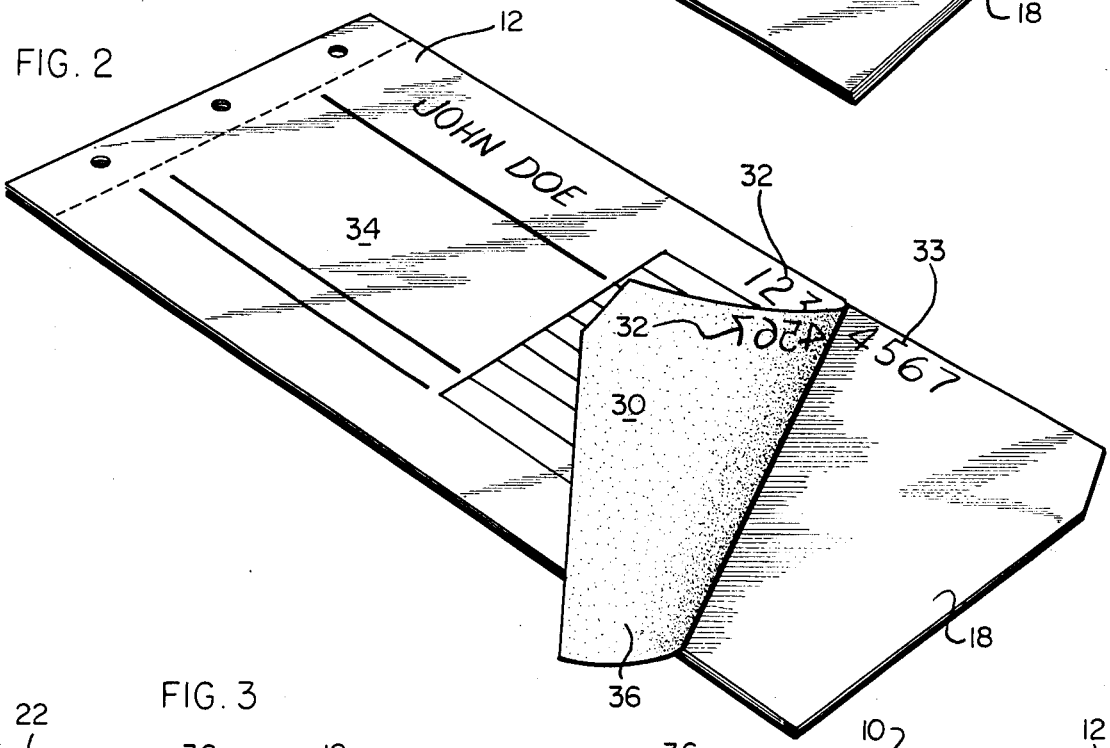
FIG. 2 is a perspective view illustrating the pack of credit card transaction slips of FIG. 1 with imprinting on the top slip lower face (back) being visible through the paper.
Figure 3:
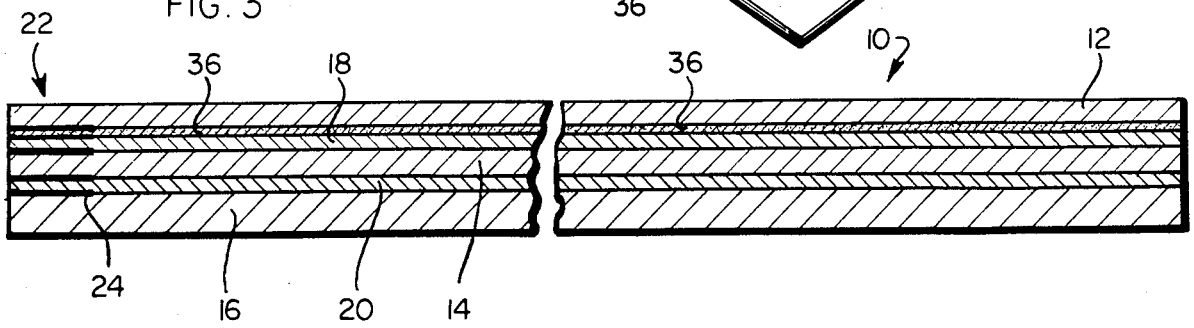
FIG. 3 is a fragmented sectional view taken along section line 3—3 of FIG. 1.

Top paper transaction slip 12 includes a plurality of positions 26 within which the sales clerk may enter information regarding the item purchased, sales price, etc. Top paper transaction slip 12 also includes a plurality of positions 28 for recording information by imprinting from a credit card issued to the customer and by imprinting from a merchant's plate. Such information normally relates to the customer's account number, customer's name, expiration date, etc., and which information in most instances is recorded in an imprinting operation using the customer's credit card, a standard commercially available imprinter fixture, and pack 10. In such an imprinting operation, duplicating medium from duplicating medium slip 18 is imprinted on the lower face 30 of top transaction slip 12 so that the imprinted information 32 (as shown in FIGS. 1 and 2) is visible when viewed from upper face 34 of top translucent slip 12 and through the paper slip.

To improve the legibility and visibility of duplicating medium imprint 32, a pigment coating 36 is applied to lower face 30 as the paper travels through the press during the manufacture of the credit card pack. As an example, starting with a translucent paper for top sheet 12, a white pigment coating is applied to lower face 30. When a duplicating medium imprint such as a carbon imprint comes in contact with the pigment coating, the contrasting black carbon imprint on the white pigment coating becomes more visible when viewed through translucent slip 12 from upper face 34 than without coating 36. That is, carbon imprint 32 strikes through (or shows through) translucent slip 12 with better intensity than the translucent paper without coating 36. Reference numeral 33 denotes the area of carbon substantially removed from medium slip 18 during imprinting.

Applying coating 36 to lower face 30 makes slip 12 less transparent, or less translucent, i.e., more nearly opaque, with the pigment coating than without the pigment coating. However, when pigment coated face 30 comes in direct imprinting contact with a color constrasting duplicating medium 18, the contrasting show-through or strke-through is more visible to the eye when viewed from upper face 34 and through the paper than if the duplicating medium imprint were on translucent paper without pigment coating 36.

It is understood of course, that the traditional use of a black carbon slip 18 as the duplicating medium is the predominant carbon color used commercially. Therefore, it is preferred to use a white colored pigment to provide the best color contrast with the black carbon. However, any light color pigment such as canary, light pink, etc. would do as well. Similarly, if a different colored carbon such as blue, red or green is utilized, pigment coating 36 would then be provided with a suitable color contrasting with the color carbon.

As an example of the present invention, the following formulations have been utilized for pigment coating 36.

EXAMPLE 1—COATING 36

55% titanium dioxide
2% wax
28% middle distillate oil
15% resin (hydrocarbon)

This formulation is mixed together and provides an opaque white ink which is printed on one surface or face of a translucent paper which will eventually become the top sheet of a credit card pack, such as top sheet 12. This coating formulation mixture is placed in an ink fountain or reservoir and applied to the translucent paper at the beginning of the printing process as part of the press operation during manufacture of the form set or pack. Any contrasting duplicating medium can be used. Black has predominantly been used, however, blue and red as well as green also provide excellent results.

EXAMPLE 2—COATING 36

59.15% ethyl alcohol
6% Cellosolve-EB (Dow Chemical Company)
2% ethylcel (Dow Chemical Company)
32.85% titanium dioxide This coating formulation is known as a "tinting" and is mixed and applied to one surface of a translucent paper as in example 1. As in example 1, any color contrasting color carbon such as black, blue, red, green can be used with excellent results.

The foregoing detailed description has been given for clearness of understanding only, and no unnecessary limitations should be understood therefrom, as modifications will be obvious to those skilled in the art.

What is claimed is:

1. In a pack of credit card transaction slips for recording information relating to a credit card transaction, including at least a top transaction slip of translucent paper joined in the pack above a duplicating medium slip for imprinting duplicating medium representing said information on the lower face of the top transaction slip, the improvement comprising:

a pigment coating on the lower face of said top transaction slip; and said pigment coating having a color which color contrasts with said duplicating medium to improve the visibility of the duplicating medium imprint on the lower face of said top transaction slip when said imprint is viewed through the upper face of said top transaction slip.

2. A pack of credit card transaction slips according to claim 1, wherein said pigment coating is printed on said lower face of the top slip.

3. A pack of credit card transaction slips according to claim 2, wherein the pigment coating is white.

4. A method of making a pack of credit card transaction slips comprising the steps of:

providing a top transaction slip of translucent paper for the pack;

providing a bottom transaction slip for the pack;

providing a duplicating medium slip for imprinting duplicating medium on the lower face of the translucent paper and on said bottom transaction slip;

coating the lower face of said top transaction slip of translucent paper with a colored pigment coating which contrasts with the color of the duplicating medium and which enables the translucent top slip to be more nearly opaque than the translucent top slip without the applied pigment coating;

joining the top transaction slip, the duplicating medium slip, and the bottom transaction slip to form a pack of credit card transaction slips with the duplicating medium slip between the top and bottom transaction slips and the lower face of the top transaction slip adjacent the duplicating medium slip;

so that there is a significant improvement in visibility and legibility of the duplicating medium imprint on the lower face of the top transaction slip when viewed through the upper face of the top transaction slip.

5. A method for making a pack of credit card transaction slips according to claim 4, wherein said coating includes the step of printing said colored pigment coating on said lower face of the top slip.

6. A method for making a pack of credit card transaction slips according to claim 5, wherein the pigment coating is white.

7. In a pack of credit card transaction slips for recording information relating to a credit card transaction, including at least a top transaction slip of transparent paper joined in the pack above a duplicating medium slip for imprinting duplicating medium representing said information on the lower face of the top transaction slip, the improvement comprising:

a pigment coating on the lower face of said top transaction slip; and said pigment coating having a color which color contrasts with said duplicating medium to improve the visibility of the duplicating medium imprint on the lower face of said top transaction slip when said imprint is viewed through the upper face of said top transaction slip.

8. A pack of credit card transaction slips according to claim 7, wherein said pigment coating is printed on said lower face of the top slip.

9. A pack of credit card transaction slips according to claim 8, wherein the pigment coating is white.

10. In a pack of credit card transaction slips for recording information relating to a credit card transaction, including at least a top transaction slip of translucent paper joined in the pack above a duplicating medium slip for imprinting duplicating medium representing said information on the lower face of the top transaction slip, the improvement comprising:

a pigment coating on the lower face of said top transaction slip enabling the translucent top slip to be more nearly opaque when compared to the translucent top slip without the pigment coating; and said pigment coating having a color which color cotrasts with said duplicating medium to improve the visibility of the duplicating medium imprint on the lower face of said top transaction slip when said imprint is viewed through the upper face of said top transaction slip.

11. In a pack of credit card transaction slips for recording information relating to a credit card transaction, including at least a top transaction slip of transparent paper joined in the pack above a duplicating medium slip for imprinting duplicating medium representing said information on the lower face of the top transaction slip, the improvement comprising:

a pigment coating on the lower face of said top transaction slip enabling the transparent top slip to be more nearly opaque when compared to the transparent top slip without the pigment coating; and said pigment coating having a color which color contrasts with said duplicating medium to improve the visibility of the duplicating medium imprint on the lower face of said top transaction slip when said imprint is viewed through the upper face of said top transaction slip.

12. A method of making a pack of credit card transaction slips comprising the steps of:

providing a top transaction slip of transparent paper for the pack;

providing a bottom transaction slip for the pack;

providing a duplicating medium slip for imprinting duplicating medium on the lower face of the transparent paper and on said bottom transaction slip;

coating the lower face of said top transaction slip of transparent paper with a colored pigment coating which contrasts with the color of the duplicating medium and which enables the transparent top slip to be more nearly opaque than the transparent top slip without the applied pigment coating;

joining the top transaction slip, the duplicating medium slip, and the bottom transaction slip to form a pack of credit card transaction slips with the duplicating medium slip between the top and bottom transaction slips and the lower face of the top transaction slip adjacent the duplicating medium slip;

so that there is a significant improvement in visibility and legibility of the duplicating medium imprint on the lower face of the top transaction slip when viewed through the upper face of the top transaction slip.

13. A method for making a pack of credit card transaction slips according to claim 12, wherein said coating includes the step of printing said colored pigment coating on said lower face of the top slip.

14. A method for making a pack of credit card transaction slips according to claim 13, wherein the pigment coating is white.

* * * * *